US008523401B2

(12) United States Patent
Huang et al.

(10) Patent No.: US 8,523,401 B2
(45) Date of Patent: Sep. 3, 2013

(54) LED PROJECTING LAMP

(76) Inventors: Chen-Lung Huang, Tainan (TW); Chuan-Pan Huang, Tainan (TW)

( * ) Notice: Subject to any disclaimer, the term of this patent is extended or adjusted under 35 U.S.C. 154(b) by 203 days.

(21) Appl. No.: 13/269,245

(22) Filed: Oct. 7, 2011

(65) Prior Publication Data

US 2013/0088874 A1 Apr. 11, 2013

(51) Int. Cl.
*F21V 29/00* (2006.01)

(52) U.S. Cl.
USPC ..... 362/294; 362/235; 362/373; 362/246; 257/88; 257/712

(58) Field of Classification Search
USPC ..... 362/294, 235, 311.02, 373; 257/712, 257/88, 89
See application file for complete search history.

(56) References Cited

U.S. PATENT DOCUMENTS 7,040,790 B2 * 5/2006 Lodhie et al. ..... 362/541
7,701,055 B2 * 4/2010 Wu et al. ..... 257/712

FOREIGN PATENT DOCUMENTS

TW M278827 10/2005

* cited by examiner

*Primary Examiner* — Ali Alavi
(74) *Attorney, Agent, or Firm* — J.C. Patents

(57) ABSTRACT

An LED projecting lamp includes a lamp holder installed with an electric source module having two conducting terminals to be connected with an external power source. The lamp holder has a combination circumference fixed therein with plural bolt joints. A lamp cup made of aluminum alloy has a bottom wall provided with a combination recess to be combined with the combination circumference of the lamp holder. A circuit board is assembled at the bottom wall of the lamp cup for receiving LEDs thereon. The lamp cup has an inner groove portion bored with radiating convection holes and an outer surface coated with radiating paint for dissipating heat produced by the LEDs. A fixing ring is positioned at the opening circumference of the lamp cup and bored with radiating convection holes, and a lampshade lens positioned over the circuit board is disposed with LED holes for receiving the LEDs.

5 Claims, 4 Drawing Sheets

LED PROJECTING LAMP

BACKGROUND OF THE INVENTION

1. Field of the Invention

This invention relates to an LED projecting lamp, particularly to one having the outer surface of a lamp cup coated with a radiating paint, and both the inner groove portion of the lamp cup and a fixing ring respectively bored with radiating convection holes. Thus, high heat produced by LEDs can quickly be dissipated by the radiating paint and through the radiating convection holes, able to prolong the service life of the LEDs.

2. Description of the Prior Art

A conventional LED lamp, as disclosed in a Taiwan patent, No. M 278827 and Titled "LED LIGHTING DEVICE", is composed of a casing that is over 2 mm in thickness, a cover plate and a relay component. The cover plate is assembled at the opening end of the casing, while the relay component is installed at the rear end of the casing for connecting an electric source. After receiving the electric source that is connected by the relay component via a circuit board, the LEDs will be started to shine and the light emitted by the LEDs will be projected out through LED shades and simultaneously, the heat energy produced by the LEDs will be absorbed by the thick casing and then transmitted out of the casing to carry out heat exchange with air, thus enabling heat energy produced by the LEDs to be exhausted out for prolonging the service life of the LED lamp. Although the thick casing of the conventional LED lamp can function to absorb and dissipate heat energy, yet the thicker the casing is, the more heat energy the casing will absorb and as a result, the temperature in the interior of the LED lamp will become excessively high to quickly cause heat exhaustion, impossible to prolong the service life of the LED lamp.

SUMMARY OF THE INVENTION

The objective of this invention is to offer an LED projecting lamp, simple in structure, low in manufacturing cost, and able to prolong service life of LEDs, promoting universality of using LEDs that save electricity, conforming to green environmental protection and decreasing volume of carbon dioxide emission.

The LED projecting lamp in the present invention includes a lamp holder, a lamp cup and a circuit board, which are combined together by means of bolts. The lamp cup integrally made of aluminum alloy has its bottom wall formed with a combination recess to be combined with the combination circumference of the lamp holder, further having an inner groove portion bored with radiating convection holes and an outer surface coated with radiating paint. A fixing ring to be secured at the opening of the lamp cup is also bored with radiating convection holes. Thus, high temperature produced by the LEDs can quickly be dissipated by the radiating paint on the outer surface of the lamp cup and through the radiating convection holes of both the lamp cup and the fixing ring, able to retard heat exhaustion and prolong service life of the LEDs.

BRIEF DESCRIPTION OF DRAWINGS

This invention will be better understood by referring to the accompanying drawings, wherein.

DETAILED DESCRIPTION OF THE PREFERRED EMBODIMENT

Figure 1:
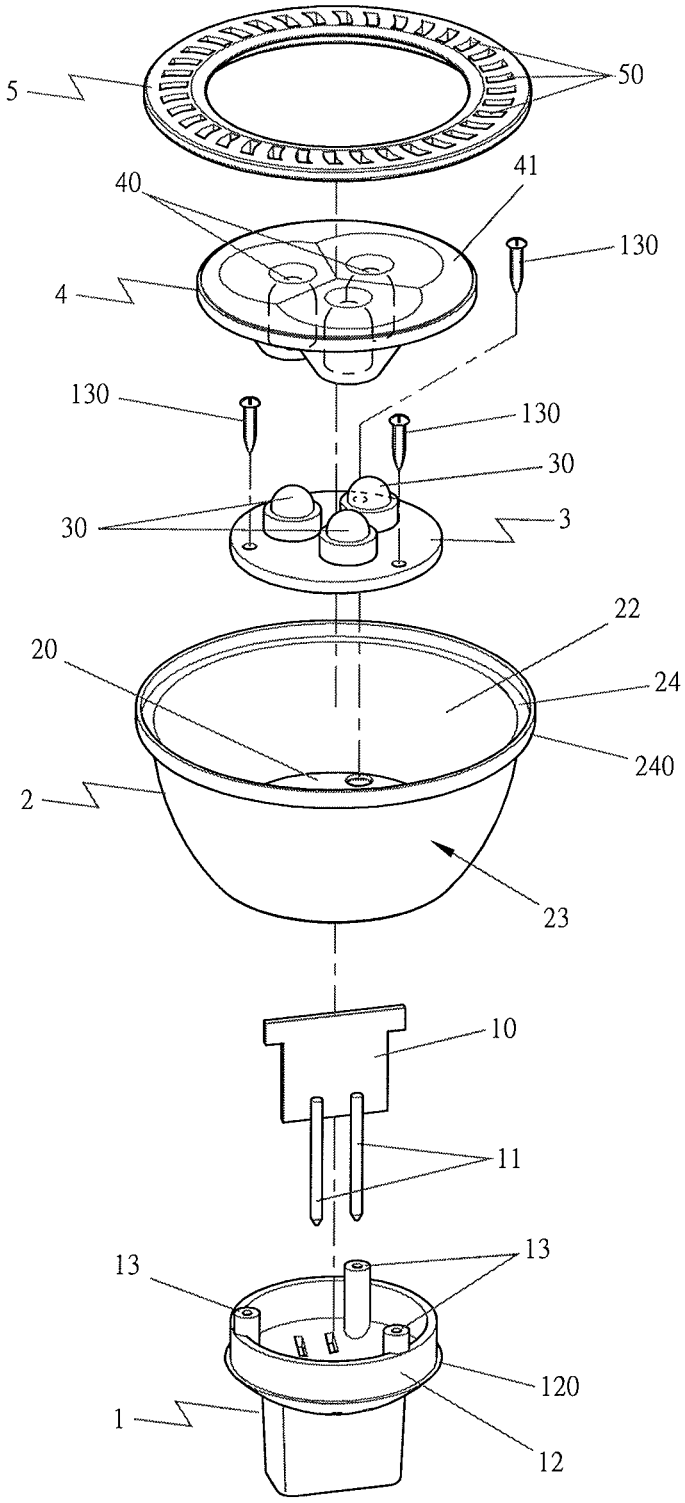
FIG. 1 is an exploded perspective view of an LED projecting lamp in the present invention.

A preferred embodiment of an LED projecting lamp in the present invention, as shown in FIGS. 1-4, includes a lamp holder 1, a lamp cup 2, a circuit board 3, a lampshade lens 4 and a fixing ring 5 as main components combined together.

The lamp holder 1 is provided thereon with an electric source module 10 having two conducting terminals 11 extending downward and protruding out of the lower side of the lamp holder 1 to be connected with an external electric source. The lamp holder 1 is formed with a combination circumference 12 having its interior secured with a plurality of bolt joints 13 respectively bored with a bolt hole for a bolt 130 to be screwed therein to combine the lamp holder 1 together with the lamp cup 2. Further, the combination circumference 12 has its outer lower side provided with an annularly protruding edge 120 to serve as a reference point of combination of the lamp holder 1 with the lamp cup 2.

Figure 2:
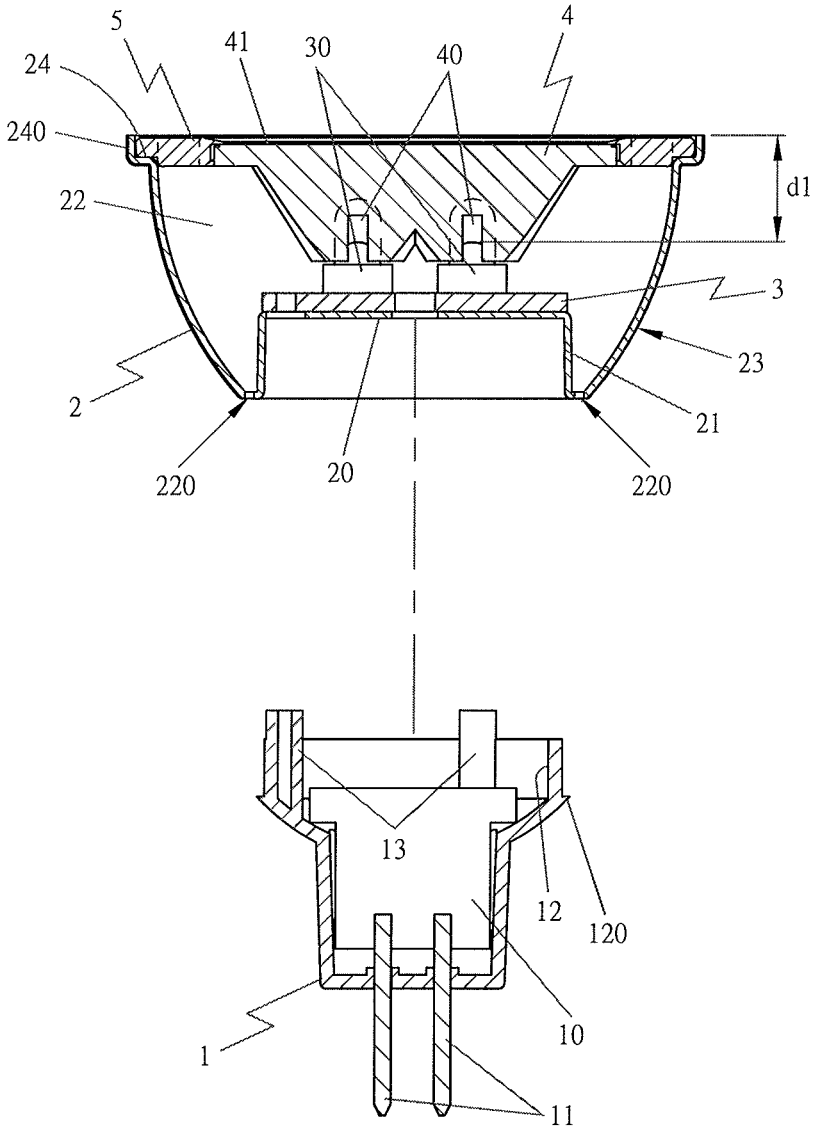
FIG. 2 is a partial exploded perspective view of the LED projecting lamp in the present invention.

The lamp cup 2 integrally made of aluminum alloy has a bottom wall 20 disposed with a combination recess 21 dented inward and upward from the bottom wall 20 and having an inner diameter matching with the outer diameter of the combination circumference 12 of the lamp holder 1, as shown in FIG. 2. Thus, the combination recess 21 can be fitted around and combined with the combination circumference 12 of the lamp holder 1 for the purpose of shortening the distance d1 between the LEDs 30 and the opening of the lamp cup 2 so as to enable the light of the LEDs 30 to be quickly concentrated and projected out.

The circuit board 3 receiving the LEDs 30 thereon is positioned at the inner side of the bottom wall 20 of the lamp cup 2 and firmly combined together with the lamp holder 1 and the lamp cup 2 by means of bolts 130.

The lampshade lens 4 located over the circuit board 3 is bored with a plurality of LED holes 40 to receive the LEDs 30 therein for concentrating and projecting light of the LEDs 30. The lampshade lens 4 is formed with an upper plane surface 41 to be pressed by the fixing ring 5 for restrictedly positioning the lampshade lens 4.

Furthermore, the lamp cup 2 is bored with radiating convection holes 220 at the bottom of an inner groove portion 22 and has outer surface coated with radiating paint 23. Thus, heat produced by the LEDs 30 can quickly be dissipated through the radiating convection holes 220 and by the radiating paint 23 for retarding heat exhaustion and prolonging service life of the LEDs 30.

Figure 3:
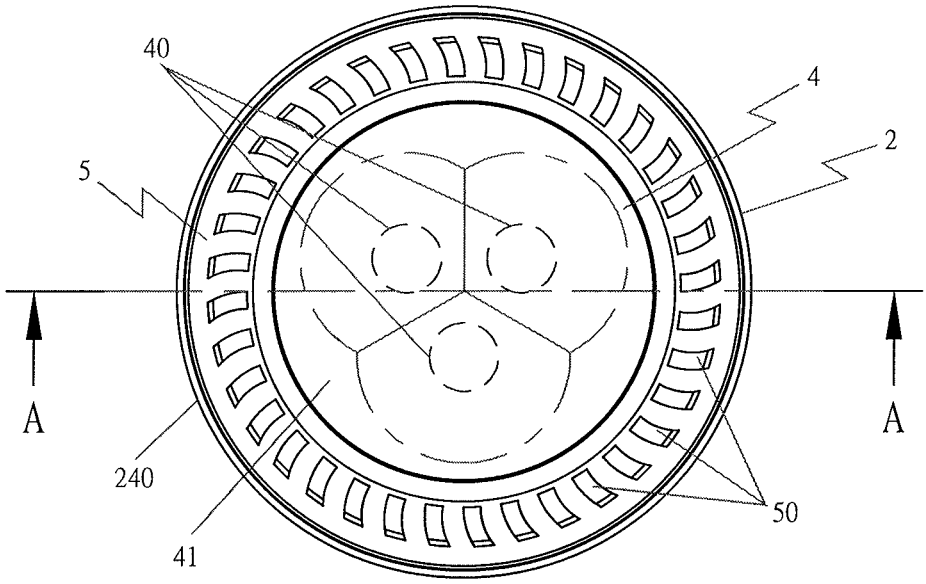
FIG. 3 is an upper view of the LED projecting lamp in the present invention.
Figure 4:
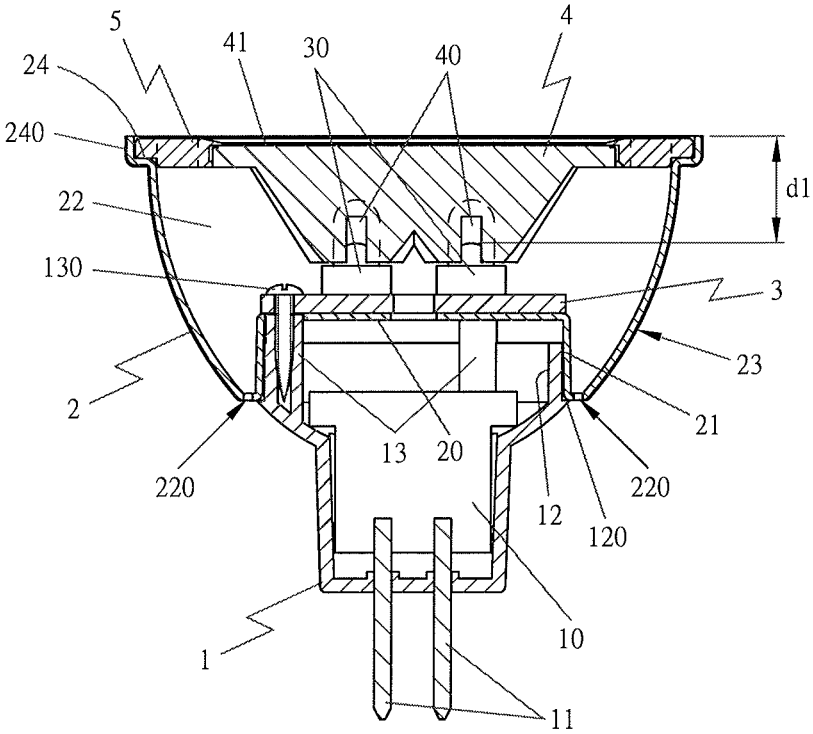
FIG. 4 is a cross-sectional view of the line A-A in FIG. 3.
Figure 5:
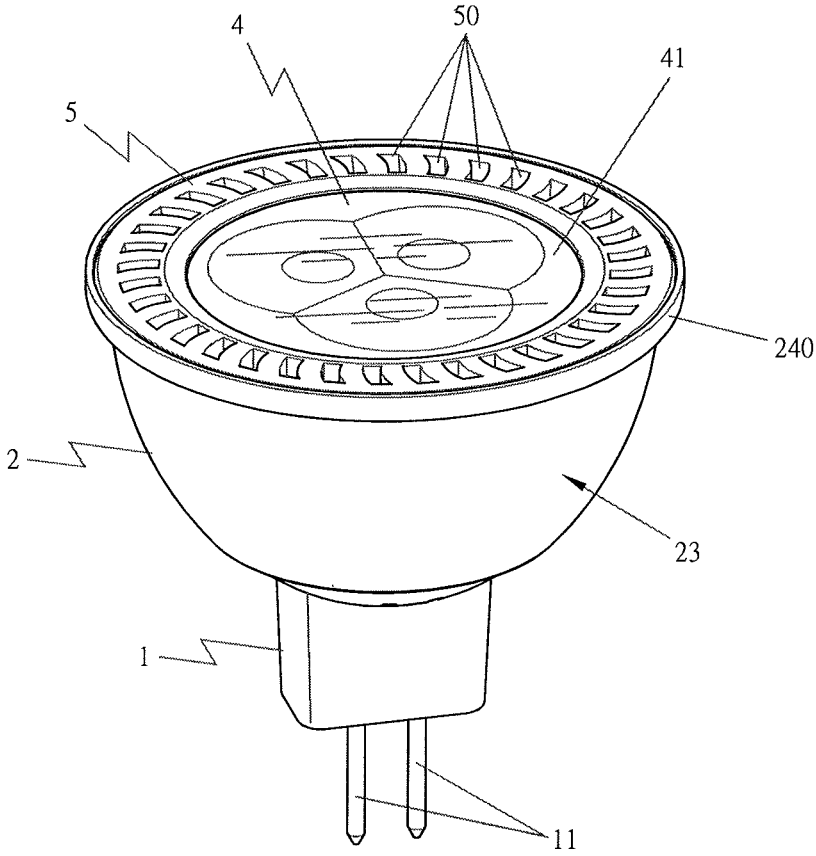
FIG. 5 is a perspective view of the LED projecting lamp in the present invention.

In addition, the lamp cup 2 has its opening formed with an opening circumference 24 having an outer side provided with a projecting circumference 240. Thus, the fixing ring 5 can be positioned by the opening circumference 24 and the projecting circumference 240 and then firmly combined together with the lamp cup 2 by means of an adhesive, as shown in FIGS. 3 and 4.

The fixing ring 5 is bored with radiating convection holes 50 to cooperate with the radiating convection holes 220 at the bottom of the inner groove portion 22 of the lamp cup 2 for functioning together. When the LEDs 30 are started to shine and the light of the LEDs 30 is concentrated and projected out through the lampshade lens 4, a part of high temperature produced by the LEDs 30 will be absorbed by the lamp cup 2 and dissipated via the radiating paint 23 of the lamp cup 2 and another part of the high temperature will be exhausted out of the lamp cup 2 from the inner groove portion 22 through the radiating convection holes 50 and 220 of both the fixing ring 5 and the lamp cup 2. Specifically, the LED projecting lamp of this invention can completely exhaust out the heat energy produced by the LEDs 30 by means of the radiating paint and the radiating convection holes, able to lower outer circumferential temperature of the LEDs, retarding heat exhaustion and prolonging service life of the LEDs 30.

To sum up, the LED projecting lamp of this invention has the following advantages.

1. The combination recess 21 dented inward and upward from the bottom wall 20 of the lamp cup 2 can shorten the distance d1 between the LEDs 30 and the opening of the lamp cup 2 for elevating light projecting efficiency, increasing efficiency of light source for decreasing the number of LEDs to be provided and producing efficiency of nearness of light source for reducing power consumption.

2. The radiating paint 23 coated on the outer surface of the lamp cup 2 can function to dissipate heat, and the radiating convection holes 50 and 220 of both the fixing ring 5 and the lamp cup 2 are able to permit the heat source produced by the LEDs 30 quickly exhausted out of the lamp cup 2 from the inner groove portion 22, prolonging the service life of the LEDs 30, lowering the volume of carbon dioxide emissions, saving energy and conforming to green environmental protection, and hence letting the LED lamp of this invention extensively accepted by consumers.

While the preferred embodiment of the invention has been described above, it will be recognized and understood that various modifications may be made therein and the appended claims are intended to cover all such modifications that may fall within the spirit and scope of the invention.

What is claimed is:

1. An LED projecting lamp comprising:

a lamp holder receiving an electric source module thereon, said electric module provided with two conducting terminals for connecting an external power source, said lamp holder formed with a combination circumference, said combination circumference having interior fixed with a plurality of bolt joints; and a lamp cup having a bottom wall disposed with a combination recess to be combined together with said combination circumference of said lamp holder, a circuit board installed at an inner side of said bottom wall of said lamp cup, said circuit board installed thereon with LEDs, said lamp holder and said lamp cup and said circuit board firmly combined together by bolts engaging with said bolt joints, a lampshade lens assembled over said circuit board, said lampshade lens bored with a plurality of LED holes for receiving said LEDs therein, said lampshade lens having function of concentrating and projecting light, said lamp cup having an inner groove portion disposed with radiating convection holes and an outer surface coated with radiating paint, said lamp cut provided with an opening circumference for positioning a fixing ring, said fixing ring bored with radiating convection holes, said radiating paint of said lamp cup and said radiating convection holes of both said lamp cup and said fixing ring functioning to quickly dissipate heat produced by said LEDs for retarding heat exhaustion and prolonging service life of said LEDs.

2. The LED projecting lamp as claimed in claim 1, wherein said combination circumference of said lamp holder has an outer side provided with an annularly protruding edge to serve as a reference point of combination with said lamp cup.

3. The LED projecting lamp as claimed in claim 1, wherein said combination recess of said lamp cup is dented inward and upward from said bottom wall of said lamp cup for shortening a distance between said LEDs and the opening of said lamp cup to enable light of said LEDs to be quickly concentrated and projected out.

4. The LED projecting lamp as claimed in claim 3, wherein an inner diameter of said combination recess matches with an outer diameter of said combination circumference of said lamp holder so that said combination recess can be fitted around and combined with said combination circumference of said lamp holder.

5. The LED projecting lamp as claimed in claim 1, wherein said lampshade lens is provided with an upper plane surface to be pressed by said fixing ring for restrictedly positioning said lampshade lens.

* * * * *